US008881562B2

(12) United States Patent
Huang et al.

(10) Patent No.: US 8,881,562 B2
(45) Date of Patent: Nov. 11, 2014

(54) MORTISE LOCK

(75) Inventors: Tsung-Chung Huang, Chiayi County (TW); Cheng-Chung Liu, Chiayi County (TW); Wei-Liang Chiang, Chiayi (TW); Ju-Lin Yang, Chiayi County (TW); Song-Gen Shyu, Chiayi County (TW); Ching-Chuan Kuo, Chiayi County (TW)

(73) Assignee: Stanley Security Solutions Taiwan Ltd, Chia-Yi (TW)

( * ) Notice: Subject to any disclaimer, the term of this patent is extended or adjusted under 35 U.S.C. 154(b) by 232 days.

(21) Appl. No.: 13/537,840

(22) Filed: Jun. 29, 2012

(65) Prior Publication Data

US 2013/0000364 A1 Jan. 3, 2013

(30) Foreign Application Priority Data

Jun. 30, 2011 (TW) ..... 100211994 U

(51) Int. Cl.

| | |
|---|---|
| ***E05B 9/08*** | (2006.01) |
| ***E05B 59/00*** | (2006.01) |
| ***E05B 17/20*** | (2006.01) |
| *E05B 63/00* | (2006.01) |
| *E05B 3/00* | (2006.01) |
| *E05B 15/02* | (2006.01) |

(52) U.S. Cl.

CPC ..... *E05B 9/084* (2013.01); *E05B 17/2084* (2013.01); *E05B 59/00* (2013.01); *E05B 63/0069* (2013.01); *E05B 3/00* (2013.01); *E05B 15/02* (2013.01)

USPC ..... 70/107; 70/370; 70/451; 70/466

(58) Field of Classification Search

CPC ..... E05B 9/00; E05B 9/02; E05B 9/08; E05B 55/00; E05B 55/005; E05B 59/00; E05B 63/24; E05B 2009/00

USPC ..... 70/106–111, 141, 145, 370, 451, 466

See application file for complete search history.

(56) References Cited

U.S. PATENT DOCUMENTS

| | | | | |
|---|---|---|---|---|
| 4,156,541 | A * | 5/1979 | Babb et al. | 70/108 |
| 5,457,975 | A * | 10/1995 | Berger et al. | 70/370 |
| 5,655,393 | A * | 8/1997 | Kuo et al. | 70/107 |
| 5,992,195 | A * | 11/1999 | Huang et al. | 70/472 |
| 6,564,596 | B2 * | 5/2003 | Huang | 70/107 |
| 7,152,442 | B2 | 12/2006 | Char et al. | |
| 8,161,780 | B1 * | 4/2012 | Huml | 70/107 |
| 8,267,442 | B2 * | 9/2012 | Tien et al. | 292/93 |
| 2002/0053227 | A1 * | 5/2002 | Chiang et al. | 70/107 |
| 2003/0070455 | A1 * | 4/2003 | Huang | 70/107 |
| 2007/0101777 | A1 * | 5/2007 | Shen | 70/107 |
| 2011/0314878 | A1 * | 12/2011 | Roth et al. | 70/107 |

* cited by examiner

*Primary Examiner* — Christopher Boswell
(74) *Attorney, Agent, or Firm* — Chun-Ming Shih

(57) ABSTRACT

A mortise lock is provided with a reinforcing plate to enhance structural rigidity and robustness for resistance against external destructive pulling forces. The reinforcing plate is disposed in abutment with an exterior cover and a door panel, and is mounted on a mounting post of the exterior cover. The reinforcing plate has a notch to receive and engage a key lock. A securing plate may be disposed between and in abutment with the door panel and a main body of a torsional returning unit which is connected to an exterior handle to further increase structural rigidity.

14 Claims, 5 Drawing Sheets

MORTISE LOCK

CROSS-REFERENCE TO RELATED APPLICATION

This application claims priority of Taiwanese Patent Application No 100211994 filed on Jun. 30, 2011

BACKGROUND OF THE INVENTION

1. Field of the Invention

The invention relates to a mortise lock, and more particularly to a mortise lock with high resistance against destructive external pulling forces.

2. Description of the Related Art

A mortise lock typically includes a latch unit that includes a deadbolt and a live bolt and that can be operated through a key lock or an exterior handle at an outside of a door, or through a rotary button or an interior handle at an inside of the door. The key lock is formed with an external screw thread, and the latch unit has a threaded hole to receive the key lock and to engage the external screw thread. For installation in a door panel, the latch unit is disposed in a latch hole disposed within the door panel and opening at a side face of the door panel, and the key lock is inserted into the threaded hole of the latch unit through a lock hole formed in an outer face of the door panel. The exterior handle is attached to an exterior-cover and the exterior cover is attached to, an outside face of the door panel. The interior handle is attached to an interior cover, and the interior cover is disposed on an inside face of the door panel and is connected to the exterior cover. An example of such a mortise lock is disclosed in U.S. Pat. No. 7,152,442.

Generally, conventional mortise locks have no interlocking means to interlock the key lock with the exterior cover. Because retention of the key lock is mainly relied on an engagement between the screw thread of the key lock and the threaded hole in the latch unit, there is no sufficient resistance against external pulling forces, and the key lock can be easily removed from the door panel by burglars using destructive forces to violently pull the key lock and to destroy the screw thread thereof for separation of the key lock from the threaded hole of the latch unit.

SUMMARY OF THE INVENTION

An object of the present invention is to provide a mortise lock with high structural strength to resist against destructive external pulling forces.

According to one aspect of the present invention, a mortise lock mountable on a door panel, comprises: a latch unit having a key lock hole; an exterior cover having a base plate portion, an aperture formed in the base plate portion in alignment with the key lock hole, amounting post projecting inwardly from an inner surface of the base plate portion, and a peripheral wall that projects inwardly and laterally from the base plate portion to surround the aperture and the mounting post; a key lock that is disposed in the aperture and the key lock hole, that is interlocked with the key lock hole, and that has an outer periphery formed with a first engaging part; and a reinforcing plate mounted on the mounting post and disposed around the key lock. The reinforcing plate includes a notch that receives the key lock, and a second engaging part disposed in proximity to the notch to engage the first engaging part. The reinforcing plate abuts against the base plate portion and has a lateral flange that projects inwardly away from the base plate portion and that has an inner end substantially flush with an inner end of the peripheral wall of the exterior cover. The lateral flange is adapted to abut against the door panel.

According to another aspect of the invention, a mortise lock comprises: a latch unit having a key lock hole; an exterior cover having a base plate portion, an aperture formed in the base plate portion in alignment with the key lock hole, a securing post projecting inwardly from an inner surface of the base plate portion, and a peripheral wall projecting inwardly and laterally from the base plate portion and surrounding the aperture and the securing post; a key lock extending through the aperture and interlocked with the key lock hole; a securing plate mounted on the securing post, and having a securing post hole disposed around the securing post, and a transmission rod hole; an exterior handle attached to the exterior cover; a torsional returning unit having a main body that is mounted on the securing post and that is disposed between the exterior cover and the securing plate, and a cam member that projects from the main body to the securing plate; and a transmission rod connected to the exterior handle to actuate the latch unit and extending through the cam member and the transmission rod hole. The securing plate has an outer side engaging the main body and an inner side adapted to engage the door panel.

According to still another aspect of the invention, a mortise lock comprises: a latch unit having a key lock hole; an exterior cover having a base plate portion, an aperture formed in the base plate portion in alignment with the key lock hole, a pair of mounting posts and a pair of securing posts, all of which project inwardly from an inner surface of the base plate portion, and a peripheral wall projecting inwardly and laterally from the base plate portion and surrounding the aperture and the mounting and securing posts; a key lock disposed in the aperture and the key lock hole, interlocked with the key lock hole, and having an outer periphery that is formed with a first engaging part; and a reinforcing plate mounted on one of the mounting posts, disposed around the key lock and abutting against the base plate portion. The reinforcing plate includes a notch that receives the key lock, a second engaging part disposed in proximity to the notch to engage the first engaging part, and a lateral flange projecting inwardly away from the base plate portion and having an inner end substantially flush with an inner end of the peripheral wall of the exterior cover. The lateral flange is adapted to abut against the door panel. The mortise lock, further includes an exterior handle attached to the exterior cover; a torsional returning unit that has a main body mounted on the securing posts, and a cam member projecting from the main body; and a transmission rod connected to the exterior handle to actuate the latch unit and extending through the cam member.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
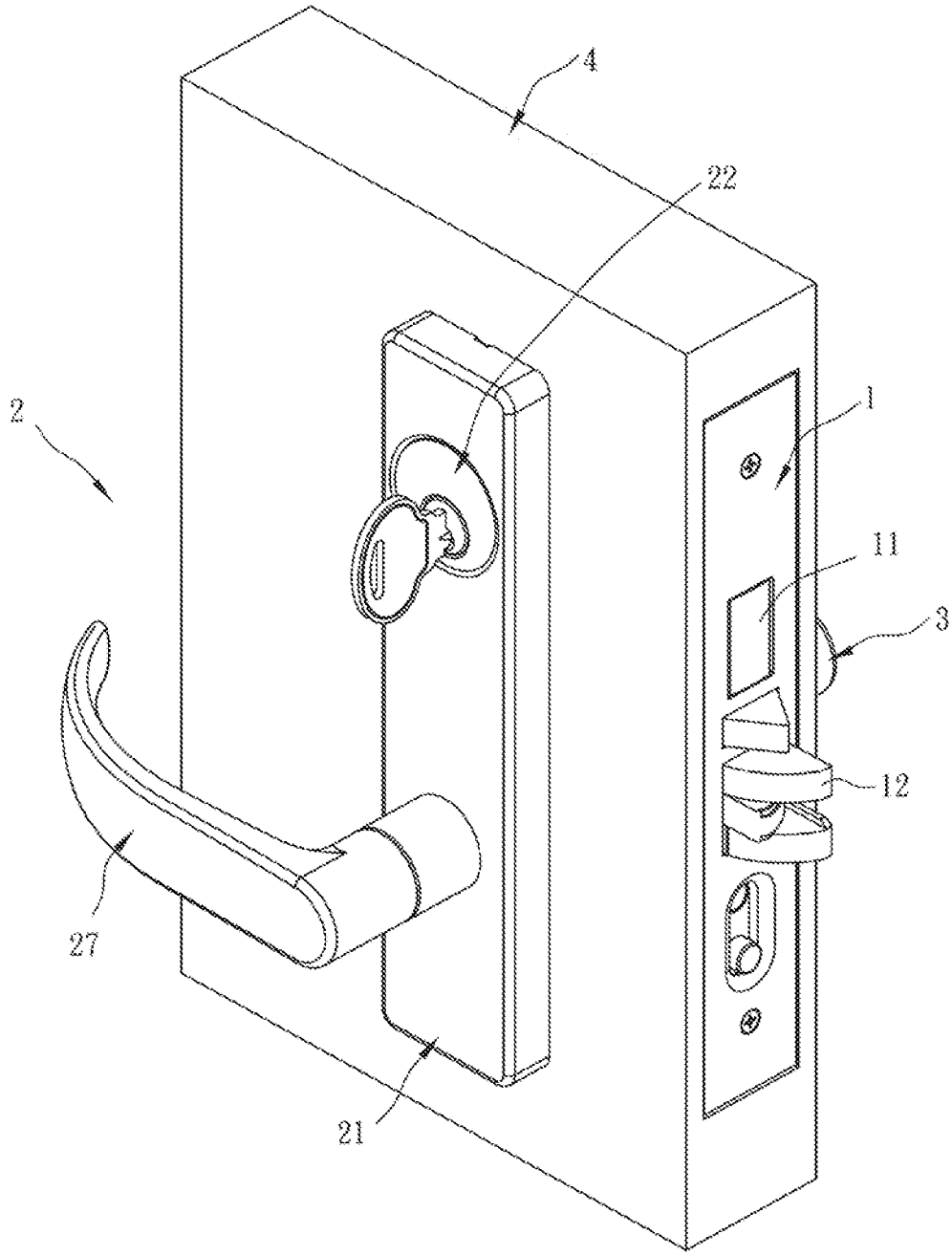
FIG. 1 is a perspective view illustrating a preferred embodiment of the mortise lock according to the present invention mounted on a door panel.
Figure 2:
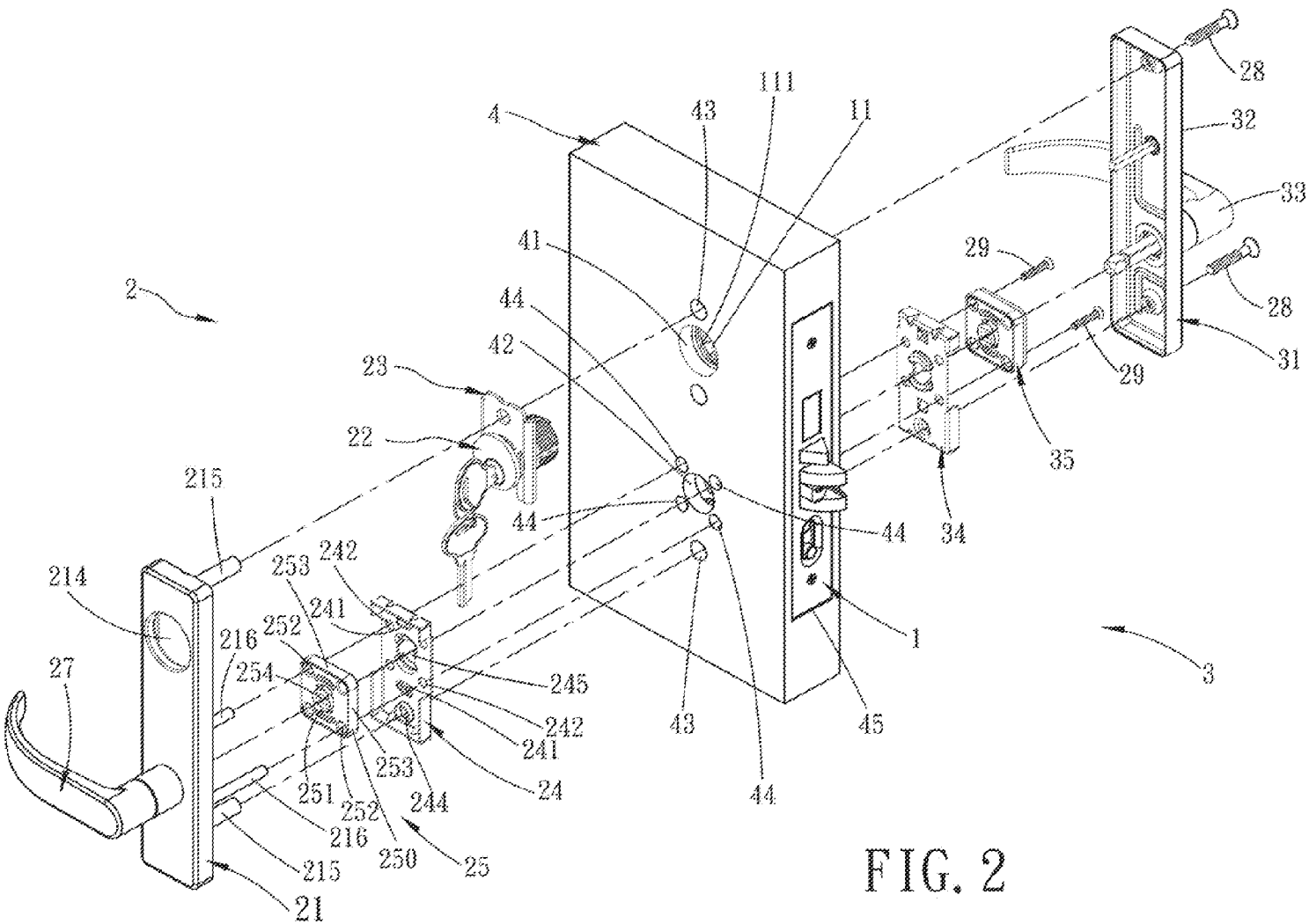
FIG. 2 is an exploded view of the preferred embodiment.
Figure 3:
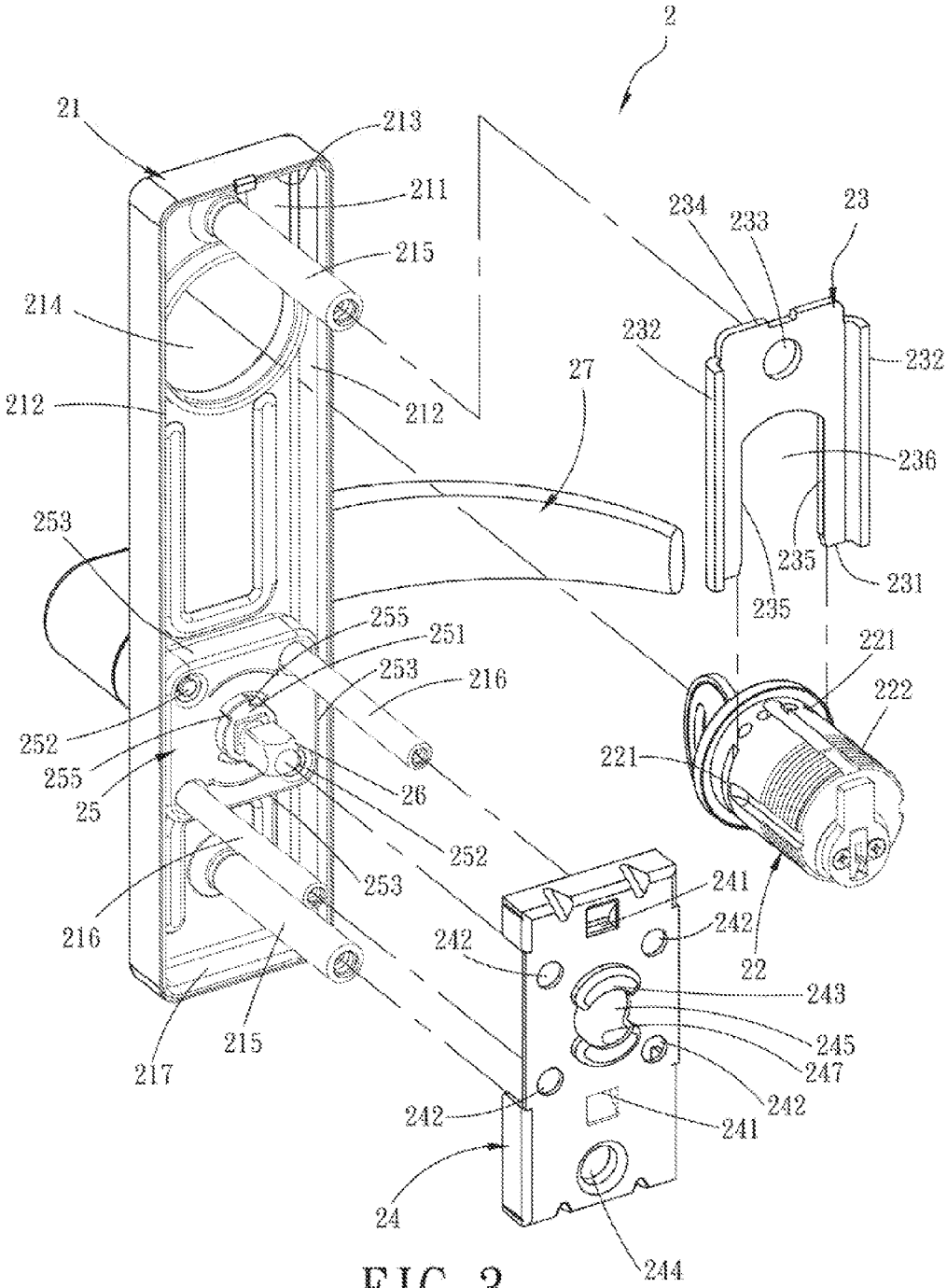
FIG. 3 is an exploded view showing an exterior lock unit of the preferred embodiment.
Figure 4:
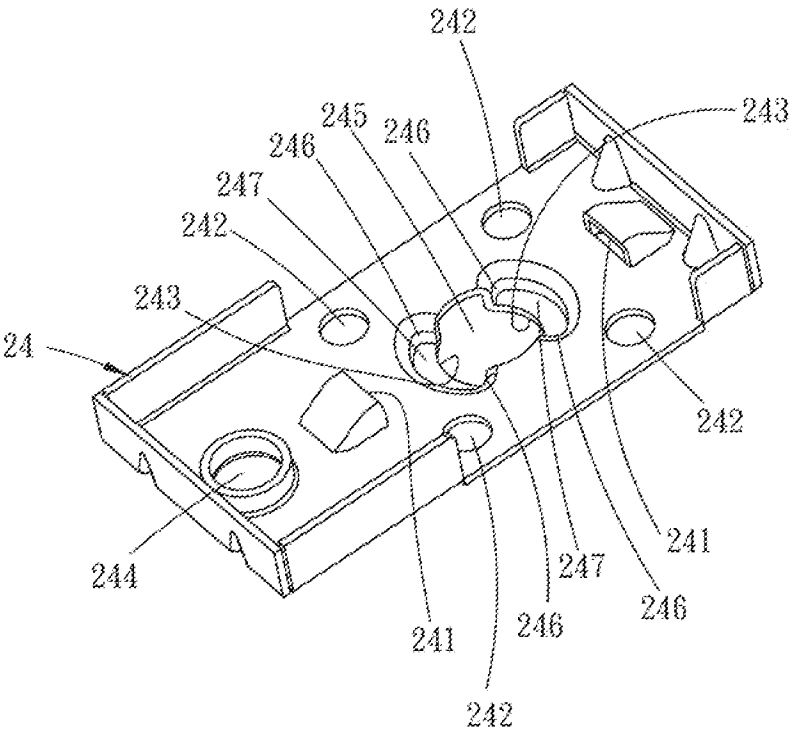
FIG. 4 is a perspective view of a securing plate of the preferred embodiment.
Figure 5:
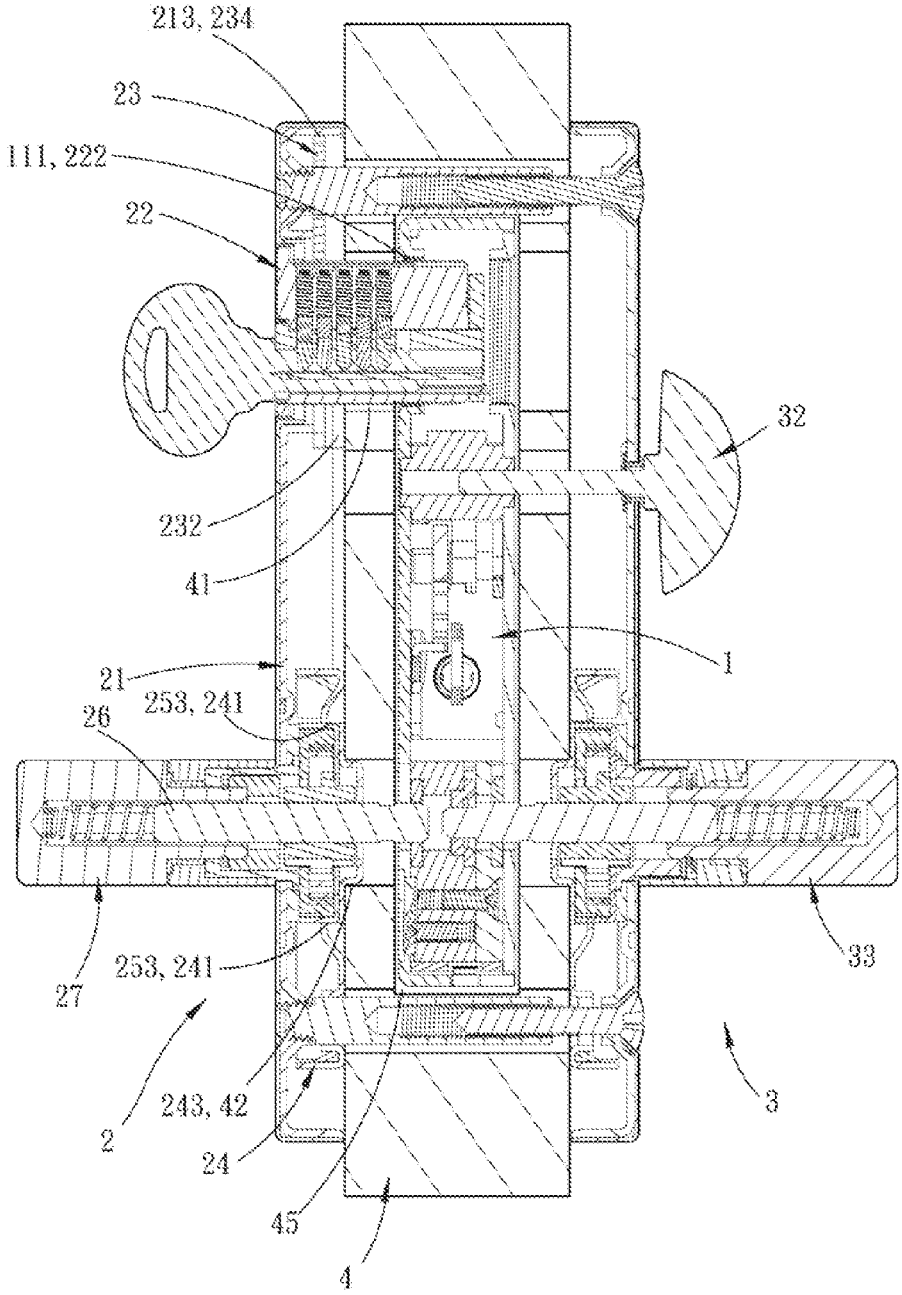
FIG. 5 is a sectional view of the preferred embodiment.

Referring to FIGS. 1 to 5, a mortise lock according to a preferred embodiment of the present invention is mountable on a door panel 4 and includes a latch unit 1, an exterior lock unit 2 and an interior lock unit 3. The exterior lock unit 2, includes an, exterior cover 21, a key lock 22, a reinforcing plate 23, a securing plate 24, a torsional returning unit 25, a transmission rod 26, and an exterior handle 27.

The door panel 4 has a latch hole 45 formed through a side face of the door panel 4. A key lock hole 41, a transmission rod hole 42, two first installation holes 43, and four second installation holes 44 are formed through an outer face of the door panel 4.

The latch unit 1 is installed in the latch hole 45 and has a key lock hole 11 with an internal thread 111. The latch unit 1 has a deadbolt 11 and a live bolt 12. Since the construction of the latch unit 1 is known and is not detailed hereinafter.

The key lock 22 has an outer periphery formed with a threaded portion 222 and two first engaging parts 221. The first engaging parts 221 are preferably configured as engaging grooves. The threaded portion 222 passes through the key lock hole 41 in the door panel 4 and is engaged with the internal thread 111 of the key lock hole 11 in the latch unit 1.

The exterior cover 21 includes a base plate portion 211 formed with an aperture 219. Two internally threaded mounting posts 215 and two internally threaded securing posts 216 project inwardly front an inner surface of the base plate portion 211. A peripheral wall extends inwardly and laterally from the base plate portion 211 and includes two sidewalls 212, an upper wall 213, and a lower wall 217. The peripheral wall surrounds the aperture 214, the mounting posts 215 and the securing posts 216.

The reinforcing plate 23 has an upper edge 234, a lower edge 231, two opposite sides that interconnect the upper edge 234 and the lower edge 231 and that are formed respectively with lateral flanges 232, a mounting post hole 233 formed between the upper edge 234 and the lower edge 231, a notch 236 indented upwardly from the lower edge 231, and two opposite second, engaging parts 235 formed in proximity to the notch 236. The notch 236 receives the key lock 22. The second engaging parts 235 are engaging edges that bound the notch 236 and that respectively engage the first engaging parts 221 of the key lock 22. The mounting post hole 233 is disposed around one of the mounting posts 215 proximate to the upper wall 213. An outer surface of the reinforcing plate 23 abuts against the base plate portion 211. The lateral flanges 232 of the reinforcing plate 23 project inwardly away from the base plate portion 211. The upper edge 234 and the lateral flanges 232 respectively abut against the upper wall 213 and the sidewalls 212 of the exterior cover 21. The lateral flanges 232 are substantially parallel to the sidewalls 212 and have inner ends that are substantially flush with inner ends of the side walls 212 and that are adapted to abut against the door panel 4.

The torsional returning unit 25 has a four-sided main body 250 that has four sides 253, a cam member 251 rotatably mounted to the main body 250, a cam hole 254 formed in the cam member 251, and four lateral through holes 252 formed around the cam hole 254. The main body 250 is mounted on the securing posts 216 and is disposed between the exterior cover 21 and the securing plate 24. Two of the lateral through holes 252 are disposed around the two securing posts 216, respectively.

The exterior handle 27 is attached movably to the exterior cover 21.

The securing plate 24 has two spaced apart clamp parts 241 protruding from the securing plate toward the main body 250, a transmission rod hole 245 formed between the clamp parts 241, two spaced apart bosses 243 protruding from the securing plate 24 and arcuated to extend around the transmission rod hole 245, two spaced apart recesses 247 arcuated to extend around the transmission hole 245 oppositely of the bosses 243, and stop elements 246 formed within the recesses 247. The bosses 243 protrude into the transmission rod hole 42 in the door panel 4 so that the inner side of the securing plate 24 is in engagement with the door panel 4. The cam member 251 is received rotatably in the recesses 247. Each recess 247 has two angularly spaced apart shoulders which serve as the stop elements 246. The stop elements 246 function to limit a rotation angle of the cam member 251. Preferably, the securing plate 24 is a stamped plate that has a bent area to form the bosses 243, the recesses 247, and the stop elements 246. An inner surface of the bent area is protruded inwardly to form the bosses 243, and an outer surface of the bent area is indented to form the recesses 247.

The main body 250 of the torsional returning unit 25 has two opposite sides 253 respectively abutting against the sidewalls 212 of the exterior cover 21, and two other opposite sides 233 clamped by the clamp parts 241 of the securing plate 24. The main body 250 is therefore in engagement with an outer side of the securing plate 24.

The securing plate 24 further has four securing post holes 242, and a mounting post hole 244. Two of the securing post holes 242 are disposed around the securing posts 216, respectively. The mounting post hole 244 is disposed around the mounting post 215 proximate to the lower wall 217. The transmission rod 26 has one end connected to the exterior handle 27. The transmission rod 26 is also connected to the cam member 251 and extends through the cam hole 254 of the cam member 251. The transmission rod 26 is inserted into the latch unit 1 through the transmission rod hole 245 in the securing plate 24 and the transmission rod hole 42 in the door panel 4. The latch unit 1 can therefore be actuated by the transmission rod 26.

The interior lock unit 3 includes an interior handle 33, an interior button 32, an interior cover 31, a securing plate 34 and a torsional returning unit 35. The construction of the securing plate 34 and the torsional returning unit 35 is the same as that of the securing plate 24 and the torsional returning unit 25 of the exterior lock unit 2. Two screws 28 and two screws 29 are used to secure the interior lock unit 2 to, the mounting posts 215 and the securing posts 216, respectively.

In use, the deadbolt 11 may be actuated by operating the key lock 22 at an outside of the door panel 4 or by operating the rotary button 32 at an inside of the door panel 4. The live bolt 12 may be actuated by operating the exterior handle 27 or the interior handle 33.

With the reinforcing plate 23 which is disposed in abutment with the base plate portion 211 of the exterior cover 21 and which has lateral flanges 232 to abut against the door panel 4, the mortise lock of the present invention possesses high structural rigidity and robustness. The structural rigidity of the mortise lock is further increased by the securing plate 24 that is mounted on the securing posts 216 in abutment with the torsional returning unit 25 and the door panel 4.

While the present invention has been described in connection with what is considered the most practical and preferred embodiments, it is understood that this invention is not limited to the disclosed embodiment but is intended to cover various arrangements included within the spirit and scope of the broadest interpretation so as to encompass all such modifications and equivalent arrangements.

What is claimed is:

1. A mortise lock mountable on a door panel, comprising: a latch unit having a key lock hole; an exterior cover having a base plate portion, an aperture formed in said base plate portion in alignment with said key lock hole, a mounting post projecting inwardly from an inner surface of said base plate portion, a peripheral wall projecting inwardly and laterally from said base plate portion and surrounding said aperture and said mounting post; a key lock disposed in said aperture and said key lock hole, said key lock being interlocked with said key lock hole and having an outer periphery that is formed with a first engaging part; a torsional returning unit and a securing plate, said exterior cover further having a pair of internally threaded securing post, said torsional returning unit being mounted on said securing posts and disposed between said exterior cover and said securing plate, said securing plate having securing post holes each of which is disposed around one of said securing posts; and a reinforcing plate mounted on said mounting post and disposed around said key lock, said reinforcing plate including a mounting post hole disposed around said mounting post, a notch that receives said key lock, and a second engaging part disposed in proximity to said notch to engage said first engaging part, said reinforcing plate abutting against said base plate portion and having a lateral flange that projects inwardly away from said base plate portion and that has an inner end substantially flush with an inner end of said peripheral wall of said exterior cover, said lateral flange being adapted to abut against the door panel.

2. The mortise lock of claim 1, wherein said peripheral wall has an upper wall, a lower wall, and two opposite sidewalls interconnecting said upper and lower walls, said reinforcing plate further including an upper edge abutting against said upper wall, a lower edge, and two opposite sides interconnecting said upper and lower edges, a pair of said lateral flanges being formed respectively at said opposite sides substantially in parallel to said opposite sidewalls, said notch being indented upwardly from said lower edge.

3. The mortise lock of claim 2, wherein said lateral flanges abut against said opposite sidewalls of said exterior cover, respectively.

4. The mortise lock of claim 1, wherein said torsional returning unit has a four-sided main body, and a cam member mounted on said main body and having a cam hole, said securing plate further having two opposite clamp parts clamping two opposite sides of said main body, and a transmission rod hole aligned with said cam hole, another two opposite sides of said main body abutting against said peripheral wall of said exterior cover.

5. The mortise lock of claim 4, wherein said securing plate further has at least one recess that receives said cam member and that is arcuated to extend around said transmission rod hole, and at least one boss that is formed oppositely of said recess and that is arcuated to extend around said transmission rod hole, said boss being adapted to protrude into a hole in a door panel.

6. The mortise lock of claim 5, wherein said recess has two angularly spaced stop elements, said cam member being rotatable limitedly between said stop elements.

7. A mortise lock comprising: a latch unit having a key lock hole; an exterior cover having a base plate portion, an aperture formed in said base plate portion in alignment with said key lock hole, a securing post projecting inwardly from an inner surface of said base plate portion, and a peripheral wall projecting inwardly and laterally from said base plate portion and surrounding said aperture and said securing post; a key lock extending through said aperture and interlocked with said key lock hole; a securing plate mounted on said securing post, and having a securing post hole disposed around said securing post, and a transmission rod hole; an exterior handle attached to said exterior cover; a torsional returning unit having a main body that is mounted on said securing post and that is disposed between said exterior cover and said securing plate, and a cam member that projects from said main body to said securing plate; and a transmission rod connected to said exterior handle to actuate said latch unit and extending through said cam member and said transmission rod hole; said securing plate having an outer side engaging said main body and an inner side adapted to engage the door panel.

8. The mortise lock of claim 7, wherein said exterior cover further has a mounting post, said securing plate further having a mounting post hole disposed around said mounting post.

9. The mortise lock of claim 7, wherein said securing plate further has at least one recess that is formed at said outer side to receive said cam member and that is arcuated to extend around said transmission rod hole, and at least one boss that is formed at said inner side and that is arcuated to extend around said transmission rod hole, said boss being adapted to engage a hole in a door panel.

10. The mortise lock of claim 9, wherein said recess has two angularly spaced stop elements, said cam member being rotatable limitedly between said stop, elements.

11. The mortise lock of claim 7, wherein said securing plate further has two opposite clamp parts disposed at said outer side to engage two opposite sides of said main body, another two opposite sides of said main body abutting against said peripheral wall of said exterior cover.

12. A mortise lock comprising: a latch unit having a key lock hole; an exterior cover having a base plate portion, an aperture formed in said base plate portion in alignment with said key lock hole, a pair of mounting posts and a pair of securing posts, all of which project inwardly from an inner surface of said base plate portion, and a peripheral wall projecting inwardly and laterally from said base plate portion and surrounding said aperture and said mounting and securing posts; a key lock disposed in said aperture and said key lock hole, said key lock being interlocked with said key lock hole and having an outer periphery that is formed with a first engaging part; a reinforcing plate mounted on one of said mounting posts, disposed around said key lock and abutting against said base plate portion, said reinforcing plate including a notch that receives said key lock, a second engaging part disposed in proximity to said notch to engage said first engaging part, and a lateral flange projecting inwardly away from said base plate portion and having an inner end substantially flush with an inner end of said peripheral wall of said exterior cover, said lateral flange being adapted to abut against the door panel; an exterior handle attached to said exterior cover; a torsional returning unit having a main body that is mounted on said securing posts, and a cam member that projects from said main body; and a transmission rod connected to said exterior handle to actuate said latch unit and extending through said cam member.

13. The mortise lock of claim 12, further comprising a securing plate mounted on said securing posts, said securing plate having securing post holes disposed respectively around said securing posts, a mounting post hole disposed around the other one of said mounting posts, a transmission rod hole for extension of said transmission rod, and a boss arcuated around said transmission rod hole and adapted to protrude into a hole of the door panel.

14. The mortise lock of claim 13, wherein said securing plate further has a recess that receives said cam member and that is arcuated around said transmission rod hole.

* * * * *